US005657619A

United States Patent [19]

Fujikawa

[11] Patent Number: 5,657,619

[45] Date of Patent: Aug. 19, 1997

[54] UMBRELLA SACK FITTING DEVICE

[75] Inventor: Kei Fujikawa, Osaka, Japan

[73] Assignee: Daito Sound Co., Ltd., Osaka, Japan

[21] Appl. No.: 512,401

[22] Filed: Aug. 8, 1995

[30] Foreign Application Priority Data

Apr. 4, 1995 [JP] Japan ..... 7-104897

[51] Int. Cl.[6] ..... B65B 43/26

[52] U.S. Cl. ..... 53/570; 53/571; 53/390; 53/384.1

[58] Field of Search ..... 53/390, 570, 571, 53/572, 255, 258, 384.1; 248/95, 99, 100

[56] References Cited

U.S. PATENT DOCUMENTS

| | | | |
|---|---|---|---|
| 3,468,100 | 9/1969 | Rubel | 53/572 |
| 3,783,580 | 1/1974 | Raudys | 53/572 |
| 4,253,292 | 3/1981 | Lipes | 53/572 |
| 4,368,608 | 1/1983 | Ray | 53/572 |
| 4,370,845 | 2/1983 | Perolls et al. | 53/572 |
| 5,495,707 | 3/1996 | Lauzon | 53/572 |

*Primary Examiner*—John Sipos
*Assistant Examiner*—Gene L. Kim
*Attorney, Agent, or Firm*—Wenderoth, Lind & Ponack

[57] ABSTRACT

An umbrella fitting device permits a wet umbrella to be inserted into an umbrella sack by simple handling, enabling a visitor to utilize an umbrella sack free of charge. The device has a top open portion 6 and a vertically elongate front open portion 4, two shafts 9, 9 fixed in position on the interior of the device at a rear side thereof and extending to a location adjacent the front open portion, and pivot members 16, 17 arranged at opposite sides of the front open portion 4 for pivotal movement within a horizontal plane. The pivot members 16, 17 are normally maintained in a position such that the pivot members lie across the front open portion by elastic elements. Locking elements 14, 14 are operative to block the front end portions of the shafts 9, 9 when the pivot members lie across the front open portion 4 and to release the front end portions of the shafts 9, 9 when the pivot members 16, 17 pivot outward. An umbrella sack assembly has one-side open, elongate umbrella sacks $A_1$, $A_2$ stacked and adhesively joined together, the umbrella sack assembly having through-holes bored at two sites. The umbrella sacks are housed within the device, fitted on the shafts 9, 9 through the through-holes, whereby an umbrella 30 may be inserted into the top portion 6 and removed from the front open portion 4 so that the umbrella 30 is automatically covered with an umbrella sack.

9 Claims, 6 Drawing Sheets

UMBRELLA SACK FITTING DEVICE

BACKGROUND OF THE INVENTION

1. Field of the Invention

The present invention relates to an umbrella sack fitting device for enabling a wet umbrella to be received into an umbrella sack so that a visitor to an establishment or store, when entering the building from outside under rainfall conditions, can carry with him or her the umbrella placed in the umbrella sack.

2. Description of the Prior Art

When a person is entering the building of an establishment or store from outside under rainfall conditions, if he brings with him a wet umbrella which had been used just before his entry into the building, the wet umbrella may be a cause of wetting the clothes of his own and/or others, or of wetting articles for sale and/or furnishings. Therefore, usually at the entrance of the building there are provided umbrella stands or umbrella holders for holding wet umbrellas.

Generally, establishments, stores, etc. receive visits of large numbers of casual visitors. In commercial buildings, such as theaters and large-size stores, which usually have large numbers of visitors, it is impracticable to have a large number of lockable umbrella stands provided therein for use by a large number of such visitors, though some establishments have some lockable umbrella stands and/or umbrella holders installed therein for anti-theft purposes. Therefore, it is general practice to allow visitors to carry with them umbrellas as they are.

In that case, it is usual that large numbers of vinyl-made elongate umbrella sacks are provided at the counter of the store or at the entrance of the building so that visitors may carry with him an umbrella sack in which is enclosed his wet umbrella.

SUMMARY OF THE INVENTION

However, the practice of opening the open portion of a vinyl made umbrella sack and placing an umbrella into the sack is troublesome and time consuming to the visitor himself. Further, during the manual process of placing a wet umbrella into the umbrella sack, possibly the wet umbrella may wet his hands and/or clothes. As such, it cannot be said that such umbrella sacks have been effectively utilized.

Accordingly, it is an object of the present invention to provide an umbrella sack fitting device which permits an umbrella to be inserted into an umbrella sack by simple handling, and which enables a visitor to utilize an umbrella sack free of charge.

In order to accomplish the above object, the present invention provides an umbrella sack fitting device comprising a top open portion and a vertically elongate front open portion. Two shafts are in position in the interior of the device at a rear side thereof and extended to a location adjacent the front open portion. Pivot members are arranged at opposite sides of the front open portion for pivotal movement within a horizontal plane, the pivot members being normally maintained by elastic elements in a position such that the pivot members lie across the front open portion. Locking elements are operative to block the front end portions of the shafts when the pivot members lie across the front open portion and to release the front end portions of the shafts when the pivot members pivot outward. An umbrella sack assembly consists of a plurality of one side open, elongate umbrella sacks that are vertically stacked, with adjacent umbrella sacks being joined to each other by fusion or the application of an adhesive. The umbrella sack assembly has through-holes bored at two sites, the umbrella sack assembly being housed within the device in a condition such that the assembly is fitted on the two shafts through the two through-holes.

An assembly of stacked umbrella sacks is housed within the device, the umbrella sack assembly having two through-holes bored therein through which extend two shafts. The foremost one of the umbrella sacks is kept open in the vicinity of the front open portion and immediately below the top open portion.

Then, an umbrella is inserted, with the ferrule down, through the top open portion so that the sheet portion of the umbrella is received into the foremost one of the umbrella sacks, and then the umbrella is moved forward while the handle portion of the umbrella is being gripped by hand, whereupon the umbrella covered with an umbrella sack causes the pivot members lying across the front open portion to pivot outward.

Following the pivotal movement of the pivot members, the locking elements which have been blocking the front end portions of the shafts release the shaft front end portions, and the through-holes of the umbrella sack holding the umbrella are disengaged from the shaft front end portions, the umbrella being thus conducted outward of the device.

As the umbrella sack which holds the umbrella therein is conducted outward through the pivot members, the pivot members return, under the force of the elastic elements, to the position at which they lie across the front open portion and, at the same time, the front end portions of the shafts are again blocked by the locking elements. This prevents the second umbrella sack from being conducted outward of the shafts.

Then, the umbrella held in the umbrella sack is pulled forward, whereupon the bond between the umbrella retaining umbrella sack and the second umbrella sack, which has been prevented from being conducted outward from the shaft, is removed. Thus, the umbrella held in the umbrella sack is now ready to be carried in.

The second umbrella sack which has been disengaged from the foremost umbrella sack is now positioned in the proximity of the front open portion so that, when an umbrella is inserted thereinto, the umbrella sack will cover the umbrella through the same process of handling as in the case of the previous umbrella sack.

DETAILED DESCRIPTION OF THE PREFERRED EMBODIMENTS

Figure 1:
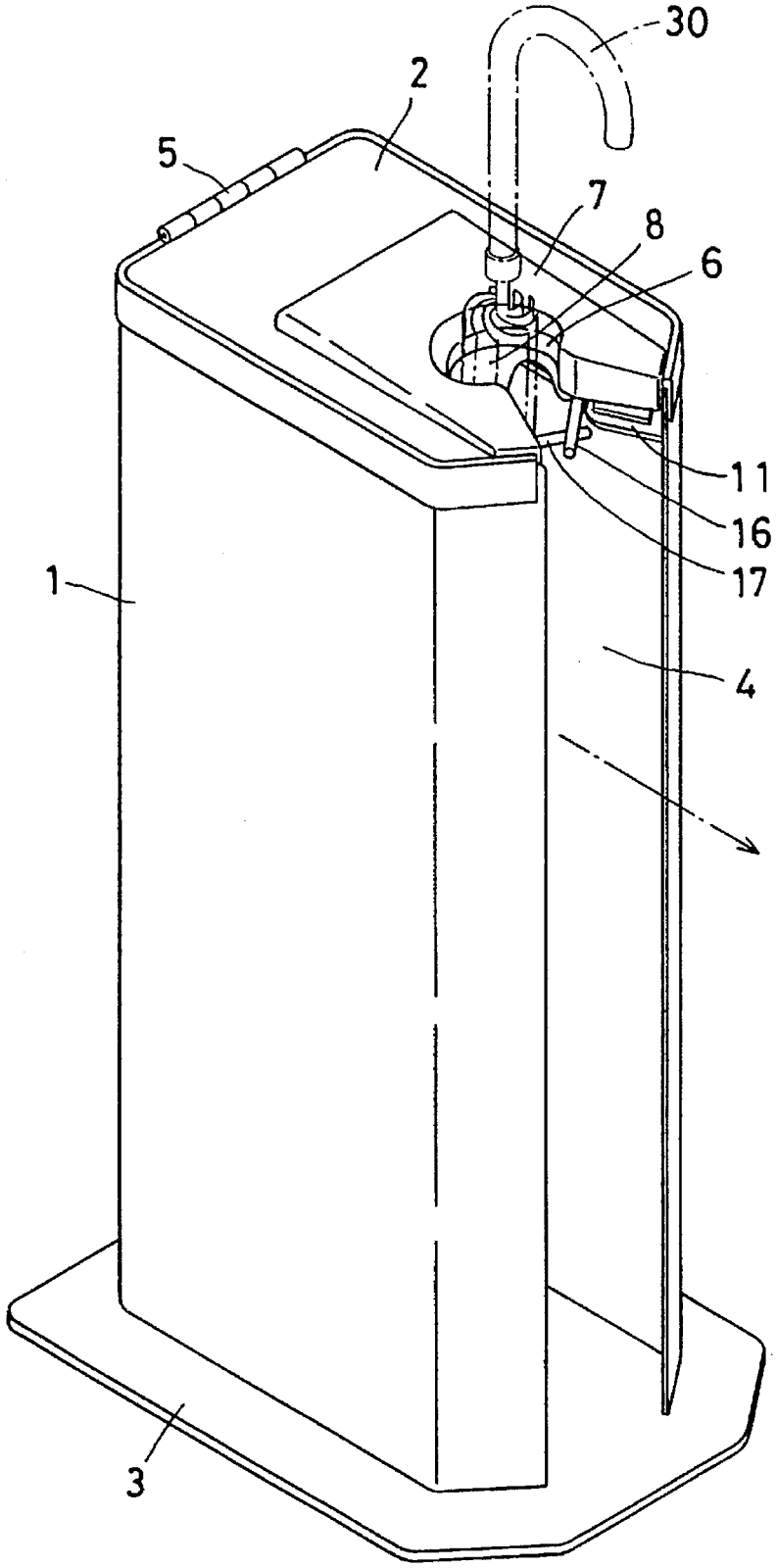
FIG. 1 is a perspective view showing an umbrella sack fitting device embodying the invention.

FIG. 1 is a perspective view showing by way of example an umbrella sack fitting device according to the invention which includes an open-topped, longitudinally extending box-shaped body 1, and a cover member 2 for covering the top opening of the body 1. The body 1 and cover member 2 are not particularly limited in the material thereof, but may be made of any water resistant metal, plastic or the like, preferably of stainless steel or like water-resistant material.

The body 1 is sized to be about 70 cm in height, about 30 cm in width, and about 35 cm in depth, such that its depth is longer than its width, and is provided at its bottom with a stabilizing plate 3 integrally affixed thereto, which provides good stability. The body 1 is formed at its front side with a vertically elongate slit-like opening which extends from the top to the bottom thereof to define a front open portion 4.

The cover member 2 is secured at its rear end to the body by means of a hinge 5 for pivotal movement about the hinge 5 portion so as to cover the top portion of the body 1. The cover member 2 is notched at its front end to define a top open portion 6 such that when the cover member 2 is closed into connection with the body 1 the top open portion 6 of the cover member 2 cooperates with the front open portion 4 of the body 1 to form a continuous opening.

The top open portion 6 is circumscribed by an opening protective element 7 made of water resistant rubber or plastic. A tongue 8 formed of a flexible, water resistant rubber material is provided at a location close to the rear end of the top open portion 6 and beneath the opening protective element 7 (see FIGS. 3 and 4).

Figure 2:
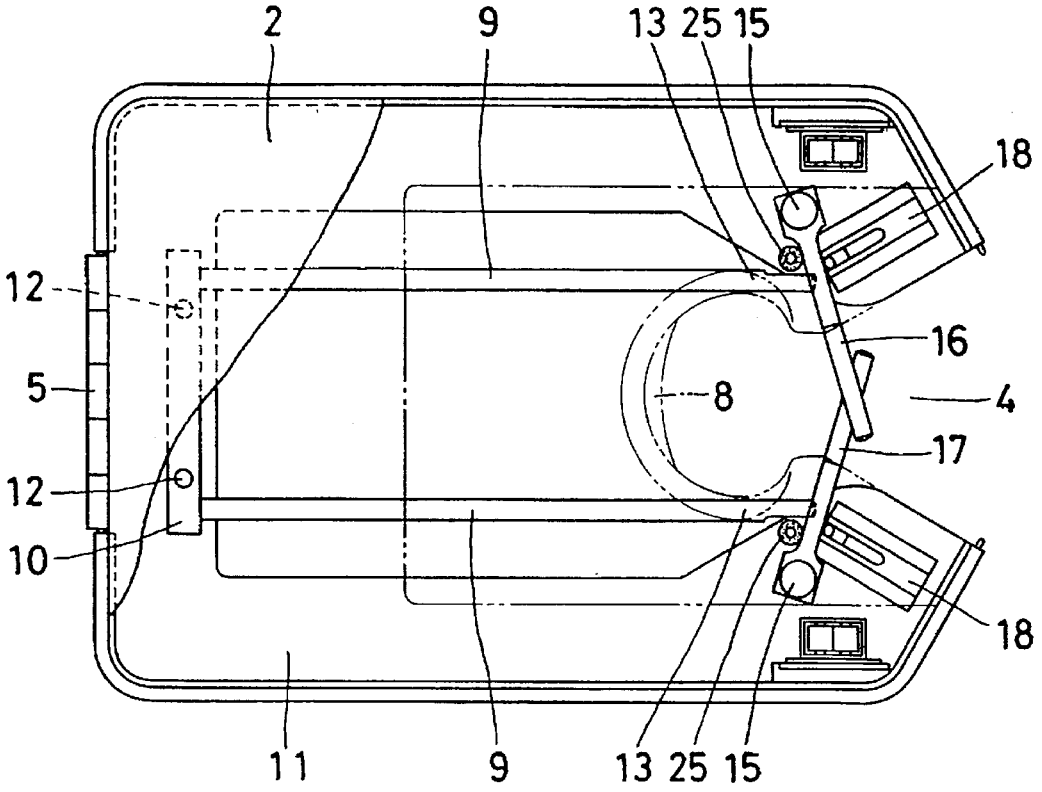
FIG. 2 is a partially cutaway plan view of the umbrella sack fitting device of the invention.

As FIG. 2 shows, two shafts 9, 9 are provided in an interior upper portion of the body 1. The shafts 9, 9 are integrally connected by a joint 10 at one end so as to be kept in parallel. The shafts are fixed in position by holes in the shaft joint 10 being fitted on two pins 12, 12 located on a rear upper side of an inner peripheral margin 11 provided on an upper inner peripheral portion of the body 1 other than the front open portion 4 thereof.

With the two shafts 9, 9 thus fixed in position, distal ends 13, 13 of the shafts reach a position adjacent the front open portion 4. Each of the shafts, at a site adjacent its distal end 13, is formed with an outward facing notch 14 (see FIG. 6).

Figure 3:
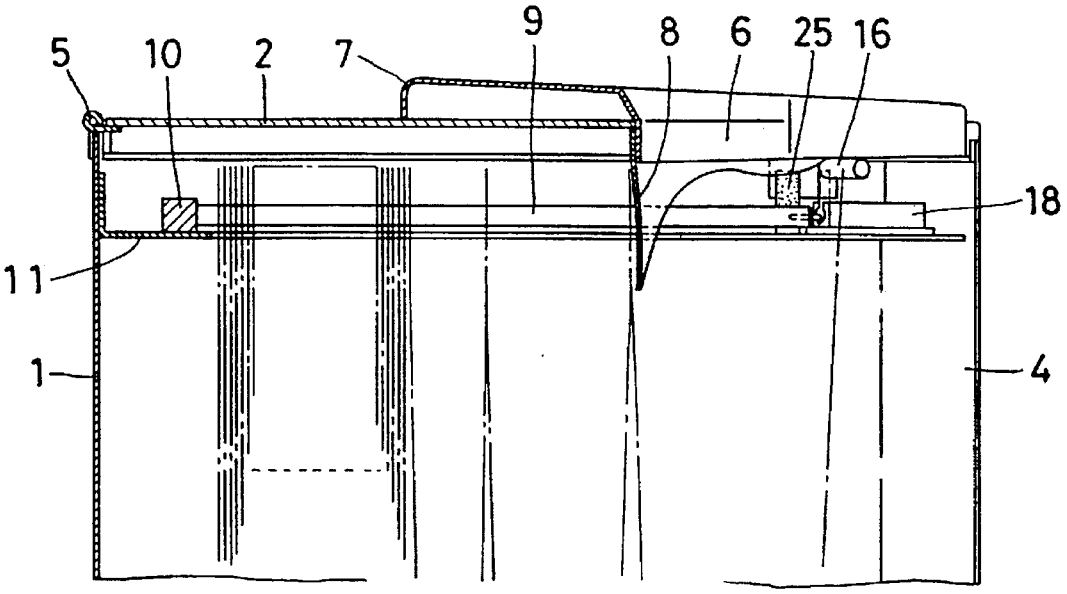
FIG. 3 is a side view in section showing main parts of the umbrella sack fitting device of the invention.
Figure 4:
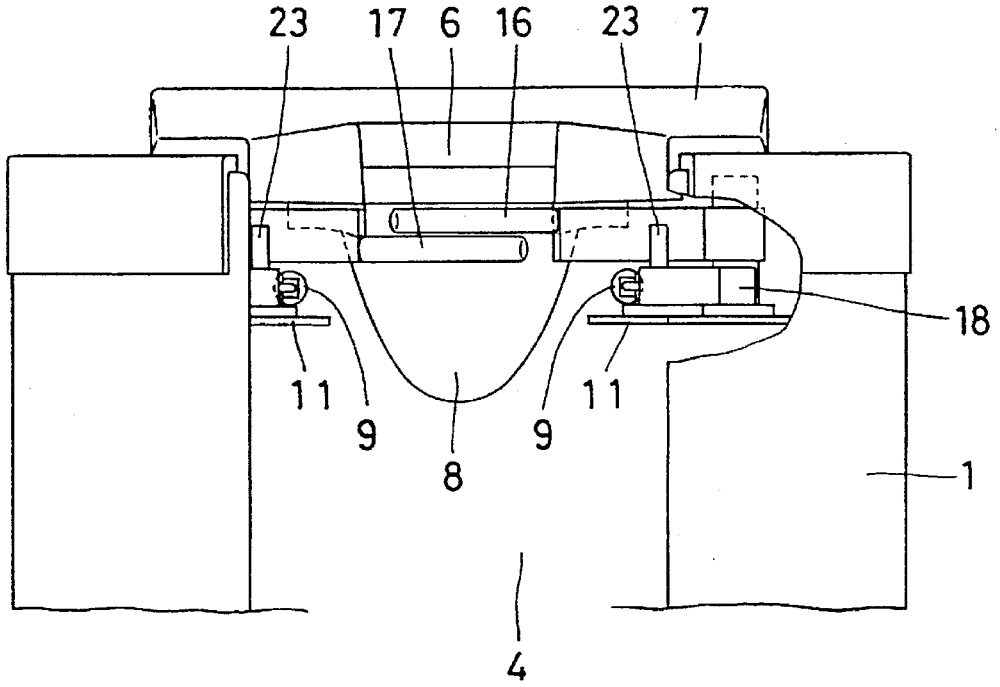
FIG. 4 is a partially cutaway front view showing main parts of the umbrella sack fitting device of the invention.

When the cover 2 is closed, the tongue 8 which is integral with the opening protective element 7 extending around the top open portion of the cover 2 is positioned between the two shafts 9, 9, as shown in FIG. 3 or 4.

On opposite sides of the front open portion 4 there are provided pivot members 16, 17 which are pivotable within a horizontal plane about respective about support shafts 15, 15 disposed on the inner peripheral margin 11.

The pivot members 16, 17 are positioned slightly above the two distal shaft ends 13, 13 and include a portion adjacent to the support shaft 15, 15 which has a sectionally square prismatic configuration, and a front end portion formed to have a sectionally circular cylindrical configuration so as to protect an umbrella bag from possible damage. When the pivot members are positioned one over the other at the front open portion 4, they are prevented from interfering with each other in such a way that the front end portion of the pivot member 16 will cross the front end portion of the pivot member 17, the former being positioned above the latter (see FIG. 4).

Elastic element holding members 18, 18 are fixed in position on the inner peripheral margin 11 at locations adjacent the front open portion 4 at both sides thereof.

Figure 5:
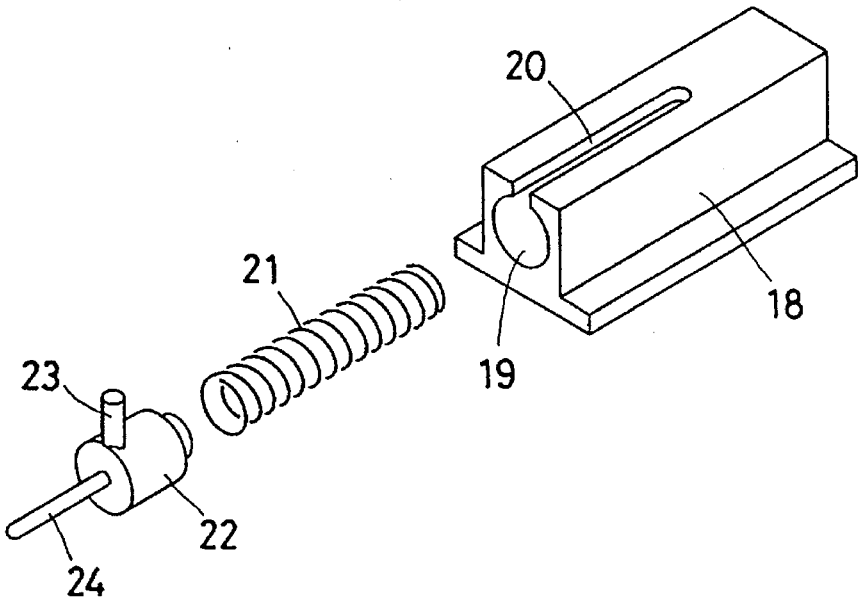
FIG. 5 is an exploded perspective view of a locking element and its peripheral parts in the umbrella sack fitting device of the invention.

As FIG. 5 shows, each of the elastic element holding members 18, 18 has a one side open bore 19 which is circular in section, and a notched groove 20 formed on the top side of the holding member and extending straight from the open end of the bore 19 and is in communication with the bore 19.

An elastic element or coiled spring 21 is housed in the bore 19, and a slide member 22 is accommodated to be slidable within the bore 19 while being biased outward by the spring 21.

A circular cylindrically shaped projection 23 is provided on the slide member 22 and projects upward through the notched groove 20 of the elastic element holding member 18 so that the projection 23 is slidable back and forth in response to the back and forth movement of the slide member 22. The slide member 22 is provided at its front end with a rod-like locking element 24.

In each elastic element holding member 18, the slide member 22 is biased obliquely backward under the force of the spring 21, so that the pivot members 16, 17 which, at their forward end, are in contact with the projections 23 on the slide members 22 are normally biased backward and are at a stop position at which the pivot member abuts against stoppers 25, 25 disposed on the inner peripheral margin 11. Thus, the forward ends of the pivot members 16, 17 are positioned one over the other across the front open portion 4 of the body 1.

The stoppers 25, 25, right and left, are circular cylindrical elements affixed to the upper surface of inner peripheral margin 11 for stopping the pivot members 16, 17 through contact with respective prismatic portions thereof, and are covered therearound with rubber or plastic so as not to damage the pivot members 16, 17 when they come into contact with the stoppers.

Figure 7:
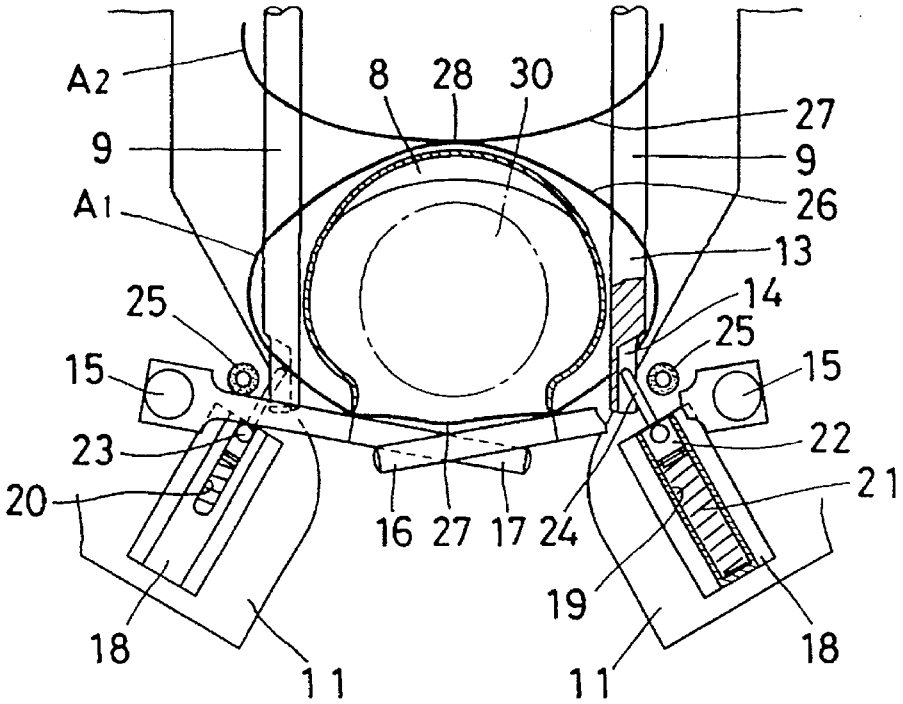
FIG. 7 is a fragmentary enlarged plan view showing the operation of the umbrella sack fitting device of the invention.

In a normal condition, each locking element 24, forced out of the respective elastic element holding member 18, is further advanced until it contacts a notched shaft portion 14, the respective distal shaft end 13 thus being blocked (see FIG. 7).

However, as the pivot members 16, 17 pivot forward, the pivot members 16, 17 respectively push the projections 23, 23 forward, and the slide members 22 slide backward while compressing the respective springs 21. The locking elements 24 are thus also retracted, thus moving away from the notched shaft portions (see FIG. 8).

Figure 6:
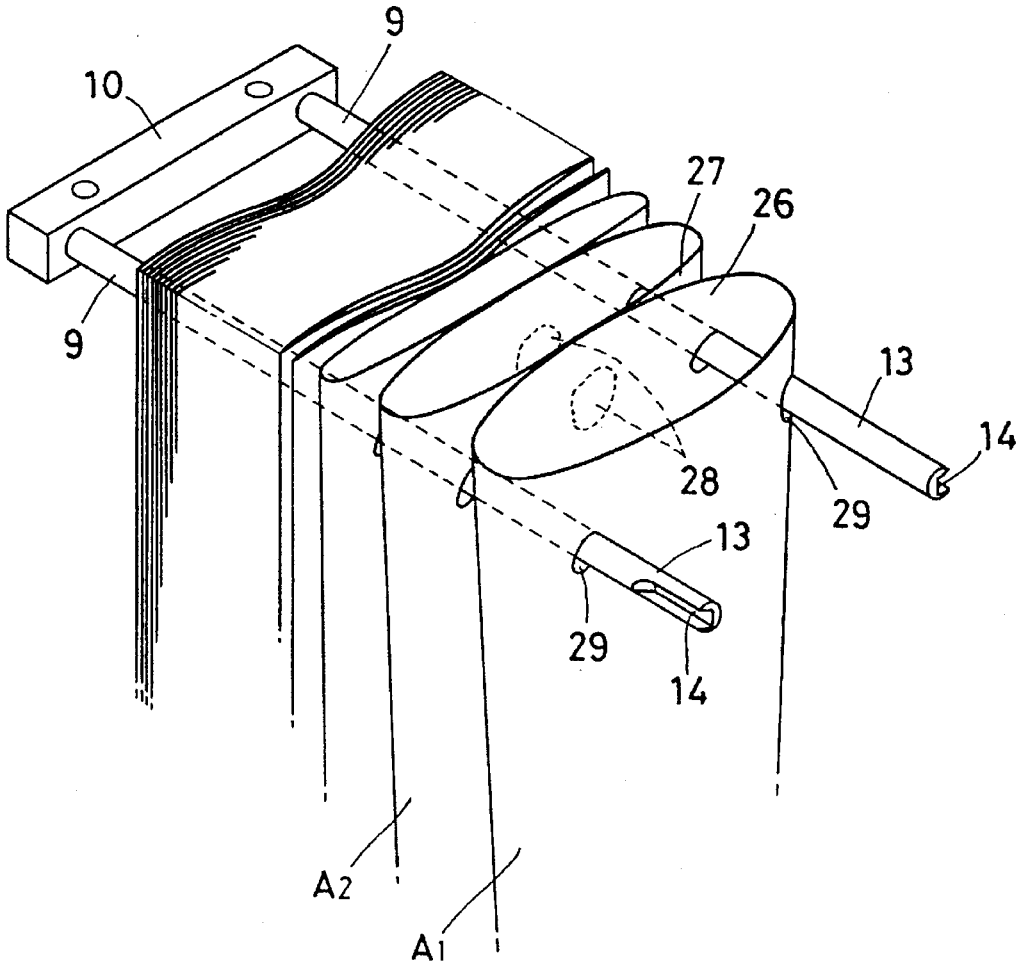
FIG. 6 is a perspective view.

FIG. 6 illustrates an umbrella sack assembly consisting of plural umbrella sacks $A_1$, $A_2$, . . . as arranged on shafts 9. Each of the umbrella sacks $A_1$, $A_2$, . . . is an elongate sack having an overall length of about 70 cm and a width of about 12 cm which is formed by joining two elongate vinyl sheets together, with their side and lower edges bonded by fusion or the application of an adhesive.

These umbrella sacks $A_1$, $A_2$, . . . are joined one to another centrally at a site adjacent their upper edge portions in such a way that the rear side 26 of each umbrella sack is bonded at a joint spot 28 of a very small area to the front side 27 of a succeeding umbrella sack, by fusion or by adhesive but with comparatively low adhesivity. In this way, many umbrella sacks, on the order of about 1500 to 2000, are trained in succession to form a continuous line of umbrella sacks.

Such an umbrella sack assembly is formed at the shoulders thereof with through-holes 29, 29, which are larger than the sectional area of the shafts 9. Accordingly, all umbrella sacks $A_1$, $A_2$, . . . have through-holes 29, 29 formed at identical positions.

The manner of operation for mounting an assembly of umbrella sacks to the umbrella sack fitting device will be explained. First, cover member 2 is opened, shafts 9, 9 are lifted upward, and joint 10 is removed from pins 12. In this case, pivot members 16, 17 are manually moved apart from each other so as to facilitate removal of shafts 9, 9 upward.

Then, shafts 9, 9 are passed through the through-holes 29, 29 provided at upper opposite sides of the umbrella sack assembly, as shown in FIG. 6.

Shafts 9, 9, with the umbrella sack assembly being suspended therefrom, are returned to their original position. In this case, too, pivot members 16, 17 are moved apart from each other by hand so that two distal shaft ends are positioned beneath pivot members 16, 17.

Then, the foremost umbrella sack $A_1$ in the umbrella sack assembly is opened at the top thereof, and pivot members 16, 17 are pulled forward thereby to ensure that the foremost umbrella sack $A_1$ is open. Thereafter, cover 2 is closed.

Plural umbrella sacks $A_1$, $A_2$ . . . , as suspended from the two shafts 9, 9, are received into the body 1. As FIG. 7 illustrates, the umbrella sack $A_1$ at the foremost position is located with its front side 27 adjacent the front open portion 4 and its rear side 26 behind the tongue 8, so that the umbrella sack is open at the top open portion 6.

Next, the manner of operation of the device for umbrella sack fitting will be explained. When entering the building from the outside under rainy conditions, a visitor inserts his or her wet umbrella 30 through the top open portion 6 of the umbrella sack fitting device, with the ferrule down, whereby the umbrella 30 is inserted into the foremost umbrella sack $A_1$ in an open condition.

Figure 8:
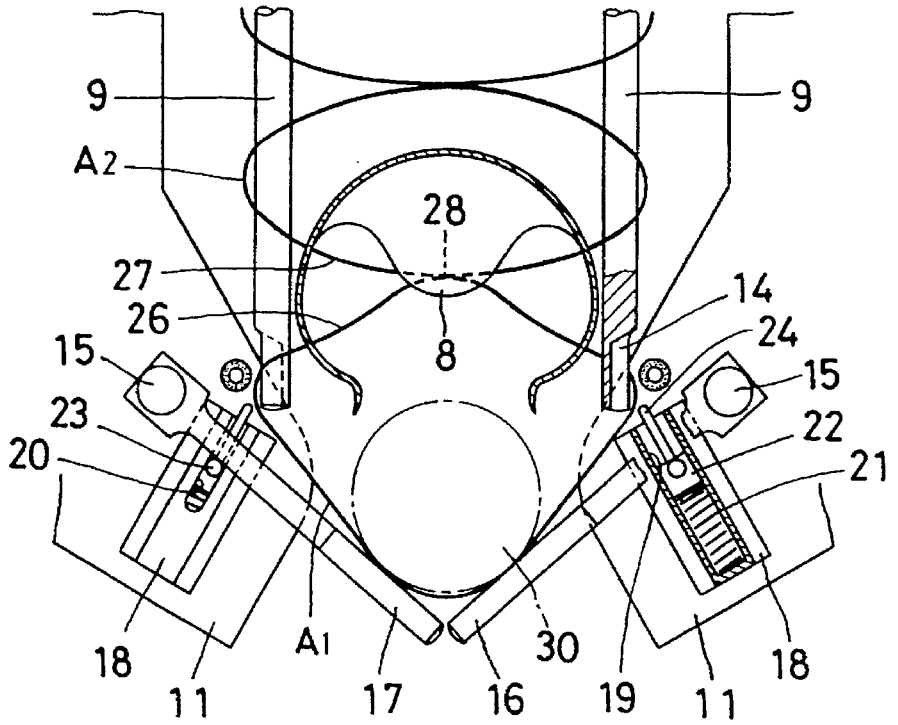
FIG. 8 is a fragmentary enlarged plan view showing the operation of the umbrella sack fitting device of the invention.

Then, the visitor applies a forward pull while holding the handle portion of umbrella 30, whereupon, as FIG. 8 illustrates, the umbrella 30 in the umbrella sack $A_1$ pivot the two lever-like pivot members 16, 17 to cause them to open wide.

Then, the pivot members 16, 17 push projections 23 of slide members 22 in the direction in which spring 21 is compressed, so that as each projection 23 is pushed the locking element 24 integral with the slide member 22 is retracted away from the notched shaft portion 14, the distal shaft portions thus being released.

In that condition, through-holes 29 of the umbrella sack $A_1$ can be disengaged from distal shaft end portions 13 without interference from locking elements 24. Thus, the umbrella sack, with umbrella 30 held therein, can be conducted out of the front open portion 4.

In this case, the rear side 26 of the umbrella sack $A_1$ in which the umbrella 30 is housed is pulled forward so that it moves forward of tongue 8 while pushing the tongue 8 upward; and at the same time, the front side 27 of an immediately succeeding umbrella sack $A_2$, connected at joint site 28 with the rear side 26 of the umbrella sack $A_1$, moves forward in response to the movement of the preceding umbrella sack $A_1$ while pushing the tongue 8 forward.

Figure 9:
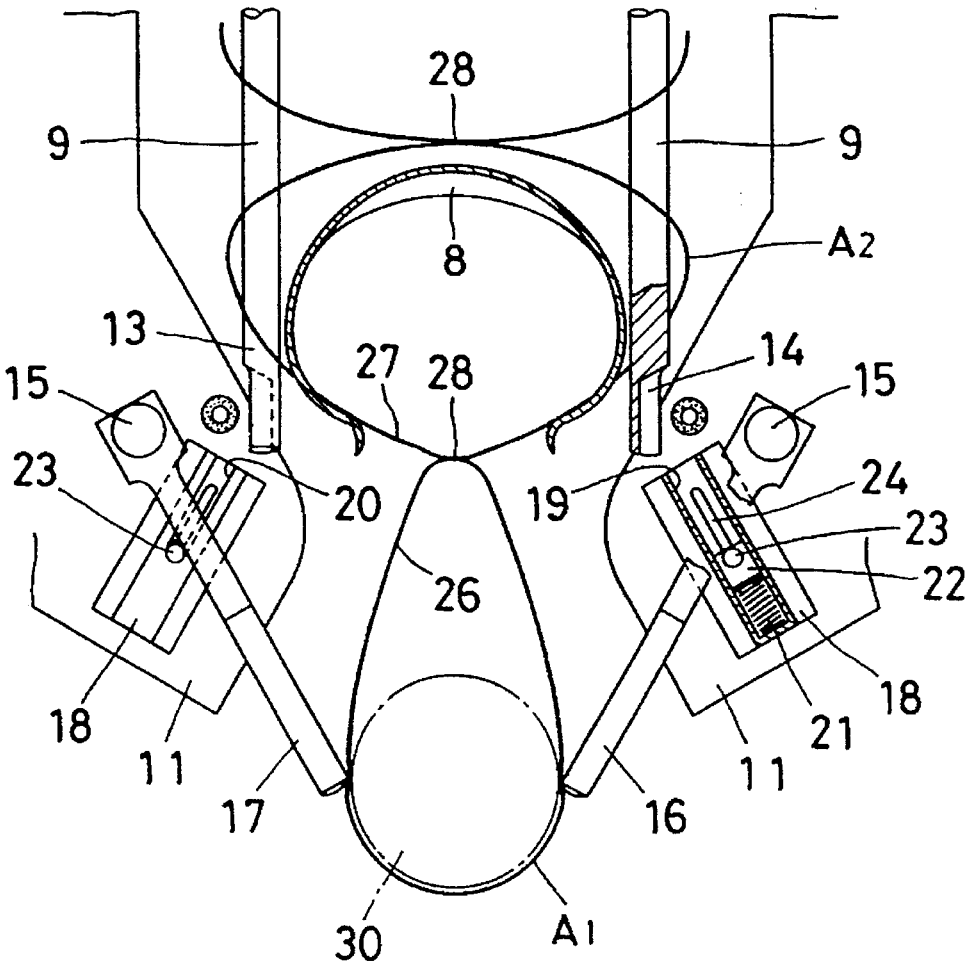
FIG. 9 is a fragmentary enlarged plan view showing the operation of the umbrella sack fitting device of the invention.

As FIG. 9 shows, when the umbrella sack $A_1$ in which the umbrella 30 is housed has cleared the front ends of the pivot members 16, 17, the pivot members 16, 17 are pushed backward by the biasing force of springs 21 via projections 23, and are thus returned to their initial positions as shown in FIG. 7.

While the umbrella sack $A_1$ in which the umbrella 30 is housed is drawn out of the device, it must be noted in this conjunction that the return of the pivot members 16, 17 to their original position has resulted in the distal shaft end portions 13 being closed by locking elements 24. Therefore, if a further attempt is made to remove the umbrella sack $A_1$ containing the umbrella 30 outward, the umbrella sacks $A_1$ and $A_2$ are separated from each other at the joint portion 28 thereof, which has a relatively weak bond, with the result that the second foremost umbrella sack $A_2$ is left within the body 1.

In this way, the umbrella 30 has its wet sheet portion covered with umbrella sack $A_1$ and accordingly the visitor can take with him the umbrella 30 as it is when he enters the building.

The second umbrella sack $A_2$ which is left within the body 1 is now located in the proximity of the front open portion 4 or a position just ahead of which the joint portion 28 at the front side 27 of the second umbrella sack has been disengaged, while the rear side 26 at a position behind the tongue 8 is prevented by the tongue 8 from moving forward. Therefore, the front side 27 and rear side 26 of the umbrella sack $A_2$ are held apart from each other to provide an opening right below the top open portion 6.

Subsequently, the next visitor may insert his or her umbrella into the top open portion 6 and then take out the umbrella from the front open portion 4 while holding the handle portion of the umbrella. Then, the umbrella sack $A_2$, while covering the umbrella therewith, draws a next succeeding umbrella sack forward in the same manner as described above.

In order to replenish the supply of umbrella sacks when the supply runs low, shafts 9, 9 are dismounted in the same manner as in the case of initial fitting and an additional assembly of umbrella sacks is fitted on the shafts. In this case, the front side of the foremost one of the leftover umbrella sacks and the rear side of the last one of the additional umbrella sacks may be secured to each other through adhesion or by stapling. By so doing it is possible to ensure that a next umbrella sack will automatically come forward at the boundary between the additional umbrella sacks and the leftover umbrella sacks.

In the foregoing embodiment, a coil-like spring is used as an elastic element operative to return each pivot member to its original position. However, it is not intended that the elastic element is limited to such a spring. Various types of materials, such as a leaf spring and rubber, may be utilized for the purpose. Each pivot member is described as having a rod-like configuration, but there is no limitation whatever in respect of its shape or otherwise. It is only required that the pivot members be pivotable in conjunction with the forward movement of umbrella and be capable of moving the locking elements back and forth. For example, the pivot members may have a folding door configuration adapted for closing the front open portion.

Further, the configuration of locking elements and their operating mechanism are not limited to those adapted for back and forth movement as used in the embodiment, provided that the locking elements are capable of movement in association with the movement of the pivot members in preventing umbrella sacks from slipping off the distal shaft ends. For example, locking elements capable of pivotal movement may be employed.

As described above, according to the present invention, simply by inserting a wet umbrella sheet portion into the top open portion of the umbrella sack fitting device and taking it out of the front open portion of the device, the sheet portion of the umbrella can be automatically covered by an umbrella sack, which process can be repetitively performed with respect to a large number of umbrella sheet portions. By virtue of this arrangement, visitors entering any establishment or shop from the outside under rainfall conditions may carry with them an umbrella placed in an umbrella sack without any particular labor or trouble. This no doubt results in labor saving for the visitor or customer and, in turn, improved customer service.

What is claimed is:

1. An umbrella sack fitting device, comprising:

a housing comprising an interior, an open top portion and a vertically elongate open front portion;

two shafts mounted in said interior of said housing at a rear portion of said interior and having parallel front end portions extending to a position adjacent to said open front portion;

two pivot members pivotable in a horizontal plane disposed on opposite sides of said open front portion and at said front end portions of said two shafts;

elastic elements biasing said two pivot members to a position in which said two pivot members extend across said open front portion, said two pivot members being pivotable forward from said position;

a pair of locking elements located adjacent said front end portions of said two shafts, said pair of locking elements being movable together with said two pivot members between a first position blocking said front end portions of said two shafts when said pivot members extend across said open front portion and a second position in which said two shafts are unblocked by said pair of locking elements when said two pivot members are pivoted forward; and an umbrella sack assembly comprising a plurality of stacked elongate umbrella sacks each having one end open, adjacent ones of said umbrella sacks being joined to each other, said umbrella sack assembly having through-holes extending therethrough adjacent to the open ends of said umbrella sacks, and said umbrella sack assembly having said two shafts extending through said through-holes thereof such that said umbrella sack assembly is housed within said housing.

2. The umbrella sack fitting device of claim 1, wherein said open top portion of said housing comprises a cover member connected to an upper end of said housing having a front open end, a protective element disposed at a peripheral portion of said front open end and a water resistant flexible tongue member disposed at a lower edge of said protective element, said tongue member engaging with a forward most one of said umbrella sacks on said two shafts so as to maintain the forward most one of said umbrella sacks in an open condition.

3. The umbrella sack fitting device of claim 1, wherein said elastic elements are housed in elastic element holding members mounted forward of said two pivot members, said elastic elements comprising coiled springs in said holding members and projections for engaging said two pivot members, and said locking elements are mounted for movement together with said projections.

4. The umbrella sack fitting device of claim 3, wherein said projections comprise sliding members having said projections projecting vertically therefrom and having said locking members projecting horizontally therefrom, said coiled springs biasing said sliding members relative to said elastic element holding members.

5. The umbrella sack fitting device of claim 3, wherein said front end portions of said two shafts comprise slots on outside portions thereof receiving said locking elements therein in said first position of said locking elements.

6. The umbrella sack fitting device of claim 1, wherein said front end portions of said two shafts comprise slots on outside portions thereof receiving said locking elements therein in said first position of said locking elements.

7. The umbrella sack fitting device of claim 1, wherein the adjacent ones of said umbrella sacks are joined to each other by a connection selected from the group consisting of a fused portion and an adhesive.

8. The umbrella sack fitting device of claim 1, wherein said shafts are removably mounted in said housing.

9. The umbrella sack fitting device of claim 1, wherein said housing comprises an interior margin member having said two shafts, said two pivot members and said elastic elements mounted thereto.

* * * * *